US008616733B1

(12) United States Patent
Millikan

(10) Patent No.: US 8,616,733 B1
(45) **Date of Patent: *Dec. 31, 2013**

(54) LIGHT EMITTING DIODE OPTICAL SYSTEM AND RELATED METHODS

(75) Inventor: Bart Millikan, Gilbert, AZ (US)

(73) Assignee: Tomar Electronics, Inc., Gilbert, AZ (US)

( * ) Notice: Subject to any disclaimer, the term of this patent is extended or adjusted under 35 U.S.C. 154(b) by 754 days.

This patent is subject to a terminal disclaimer.

(21) Appl. No.: 12/428,253

(22) Filed: Apr. 22, 2009

(51) Int. Cl.
*F21V 3/00* (2006.01)
*F21V 5/00* (2006.01)

(52) U.S. Cl.
USPC ..... 362/311.02; 362/249.02; 362/800

(58) Field of Classification Search
USPC ..... 362/249.02, 311.02, 800
See application file for complete search history.

(56) References Cited

U.S. PATENT DOCUMENTS 6,048,083 A * 4/2000 McDermott ..... 362/337
6,547,423 B2 4/2003 Marshall et al.
6,679,621 B2 1/2004 West et al.
6,724,543 B1 4/2004 Chinniah et al.
6,803,607 B1 * 10/2004 Chan et al. ..... 257/98
7,021,797 B2 * 4/2006 Minano et al. ..... 362/355
7,083,313 B2 8/2006 Smith
7,246,917 B2 7/2007 Rhoads et al.
7,306,351 B2 12/2007 Chao et al.
7,390,109 B2 6/2008 Li et al.
7,433,134 B2 10/2008 Chou et al.
7,438,445 B2 10/2008 Shiau et al.
7,458,703 B2 12/2008 Han et al.
7,473,937 B2 1/2009 Park et al.

* cited by examiner

*Primary Examiner* — Jason Moon Han
(74) *Attorney, Agent, or Firm* — Booth Udall Fuller, PLC

(57) ABSTRACT

A light emitting diode (LED) optical system. Implementations may include an LED coupled with a printed circuit board and an optic. The optic may include a first end and a second end opposing the first end. The optic may also include a first optical stage including the first end and a second optical stage including the second end. The first optical stage may include a total internal reflector and a second optical stage includes an upper reflector located at the second end. The optic may be coupled over the LED at the first end. The second optical stage may be configured to emulate a point light source for an outer lens coupled over the LED optical system using light emitted from the LED.

26 Claims, 6 Drawing Sheets

LIGHT EMITTING DIODE OPTICAL SYSTEM AND RELATED METHODS

BACKGROUND

1. Technical Field

Aspects of this document relate generally to optical systems such as optics used for transmitting, projecting, or reflecting light for light emitting diodes (LEDs).

2. Background Art

The use of light emitting diodes (LEDs) as light sources in a wide variety of applications is well known. Lighting systems employing a wide variety of LED optical systems have been devised to direct the light emitted by one or more LEDs in a desired direction. Because light is naturally emitted by most LEDs in a broad angular pattern, conventional LED optical systems utilize collimation or focusing optics to gather the light emitted and direct it to form a desired light pattern. In systems where light is desired to be directed primarily laterally from the LED, turning mirrors or specialized side-emitting LEDs may be employed.

SUMMARY

Implementations of a light emitting diode (LED) optical system may include an LED coupled with a circuit board and an optic. The optic may include a first end and a second end opposing the first end. The optic may also include a first optical stage including the first end and a second optical stage including the second end. The first optical stage may include a total internal reflector and a second optical stage includes an upper reflector located at the second end. The optic may be coupled over the LED at the first end. The second optical stage may be configured to emulate a point light source for an outer lens coupled over the LED optical system using light emitted from the LED.

Implementations of LED optical systems may include one, all, or any of the following:

The LED may be a Lambertian radiation pattern LED.

The optic may include an opening configured to receive the LED, wherein the opening may taper into the optic beyond an end of a rotationally symmetric bowl-shaped portion of the optic into a rotationally symmetric cone-shaped portion of the optic.

The upper reflector may be substantially cone-shaped and include a stack including aluminum, silver, gold, chromium, and any combination thereof.

The upper reflector may be substantially cone-shaped and include a stack having a material with a higher index of refraction than a material included in the optic or a material with a lower index of refraction than a material included in the optic.

The second optical stage is configured to produce a substantially lateral light pattern when the outer lens is coupled over the LED optical system.

The outer lens may be a Fresnel lens.

Implementations of a first optic for a light emitting diode (LED) optical system may include a first end having a rotationally symmetric bowl-shaped portion with an opening therein configured to couple over an LED. The opening may have a first bowl diameter and may be centered within the rotationally symmetric bowl-shaped portion. The rotationally symmetric bowl-shaped portion may enlarge from the first bowl diameter to a second bowl diameter at a lip of the rotationally symmetric bowl-shaped portion opposing the opening. A second end may oppose the first end where the second end includes a rotationally symmetric cone-shaped portion coupled with the rotationally symmetric bowl-shaped portion at the lip. The rotationally symmetric cone-shaped portion may have a first cone diameter substantially equal to the second bowl diameter and a second cone diameter smaller than the first cone diameter at a cone end opposing the rotationally symmetric bowl-shaped portion. The second end may include an upper reflector coupled at the cone end where the upper reflector has a diameter substantially equal to the second cone diameter.

Implementations of a first optic for an LED optical system may include one, all, or any of the following:

The opening in the rotationally symmetric bowl-shaped portion may extend into the optic toward the second end of the optic beyond the lip.

The opening may include a second opening diameter at an end of the opening located beyond the lip where the second opening diameter is smaller than the first bowl diameter and the opening tapers from the first bowl diameter to the second opening diameter.

The upper reflector may be substantially cone-shaped and include a stack including aluminum, silver, gold, chromium, and any combination thereof.

'The upper reflector may be substantially cone-shaped and include a stack including a material with a higher index of refraction than a material included in the optic or a material with a lower index of refraction than a material included in the optic.

Implementations of a second optic for a light emitting diode (LED) optical system may include a first optical stage including a total internal reflector and a second optical stage including an upper reflector where the upper reflector opposes an opening in the first optical stage. The first optical stage may be configured to couple over an LED at the opening in the first optical stage. The upper reflector may have a diameter smaller than a largest diameter of the first optical stage.

Implementations of a second optic for a LED optical system may include one, all, or any of the following:

The optic may further include an opening tapering into the first optical stage beyond an end of a rotationally symmetric bowl-shaped portion of the first optical stage into a rotationally symmetric cone-shaped portion of the first optical stage.

The upper reflector may be substantially cone-shaped and may include a stack including aluminum, silver, gold, chromium, and any combination thereof.

The upper reflector may be substantially cone-shaped and include a stack including a material with a higher index of refraction than a material included in the optic or a material with a lower index of refraction than a material included in the optic.

The second optical stage is configured to produce a substantially lateral light pattern when a Fresnel lens is coupled over the LED optical system.

Implementations of light emitting diode (LED) optical systems, implementations of first optics, and implementations of second optics may utilize implementations of a method of distributing light from an LED. Implementations of the method may include receiving light from an LED at a first end of an optic coupled over the LED and focusing the light using total internal reflection on an upper reflector included in a second end of the optic opposing the first end, where the upper reflector has a diameter smaller than a largest diameter of the first end. The method may also include reflecting the light from the second end of the optic using the upper reflector.

Implementations of a method of distributing light from an LED may include one, all, or any of the following:

The method may include emulating a point light source for an outer lens coupled over the LED and the optic using the upper reflector.

The method may include generating a substantially lateral light pattern with the outer lens and the light from the LED.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended light emitting diode (LED) optical system and/or assembly procedures for an LED optical system will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such LED optical systems and implementing components, consistent with the intended operation.

Figure 1:
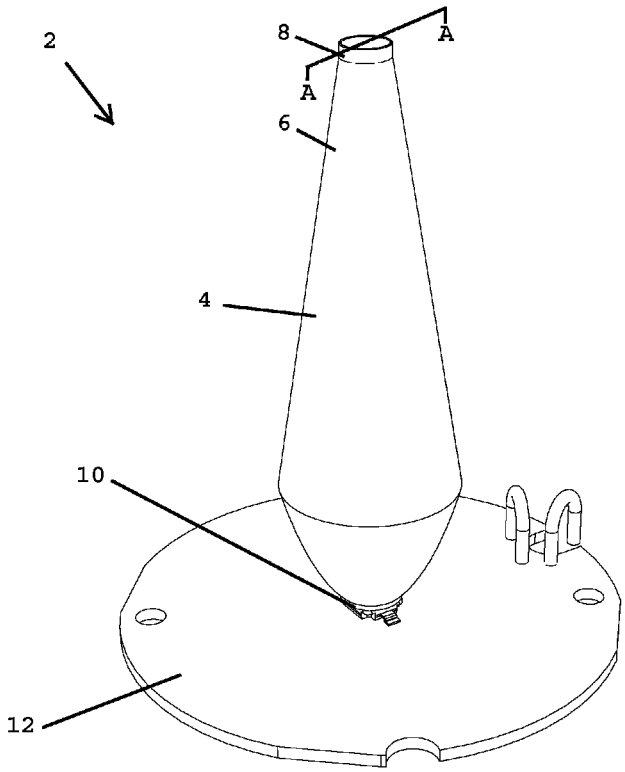
FIG. 1 is a front perspective view of an implementation of a light emitting diode (LED) optical system showing the sectional line A.
Figure 2:
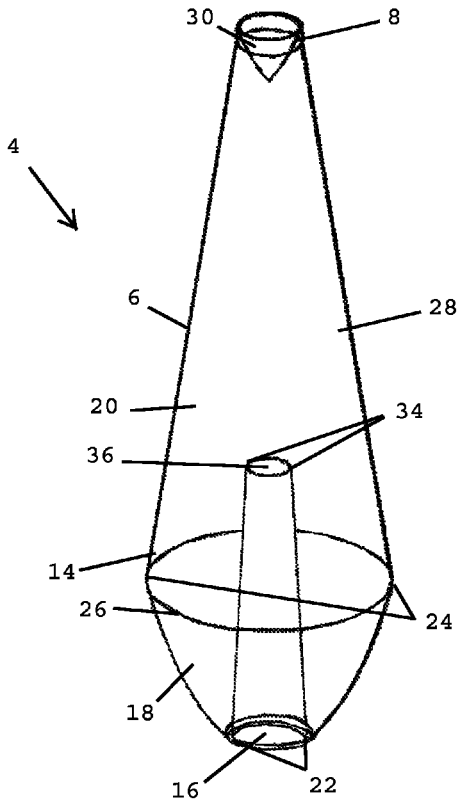
FIG. 2 is a front perspective view of the internal structure of an implementation of an optic for an LED optical system.

Referring to FIG. 1, an implementation of an LED optical system 2 is illustrated. The system 2 includes an optic 4 having a first stage 6 and a second stage 8 coupled over an LED 10 coupled to a circuit board 12. In particular implementations, the LED may exhibit a Lambertian radiation pattern and be coupled with the circuit board in any of a wide variety of conventional ways. In addition, the LED may be a single chip LED or a multi-chip LED with the multiple chips in either the same package or separate packages in particular implementations. Referring to FIG. 2, an implementation of the optic 4 of the system 2 illustrated in FIG. 1 is shown with the outer surfaces rendered transparent to illustrate optic's 4 internal structures. As illustrated, the first stage 6 includes a first end 14 that includes an opening 16, a rotationally symmetric bowl-shaped portion 18, and a rotationally symmetric cone-shaped portion 20. As illustrated, the opening 16 has a first bowl diameter 22. As used in this document, bowl-shaped includes any conical optical surface, including, by non-limiting example, spherical, aspheric, parabolic, hyperbolic, planar, and linear surfaces. The optic 4 enlarges from the first bowl diameter 22 to a second bowl diameter 24 at a lip 26 of the rotationally symmetric bowl-shaped portion 18 that opposes the opening 16. In particular implementations, the first stage 6 includes a rotationally symmetric cone-shaped portion 28 that is coupled with the rotationally symmetric bowl-shaped portion 18 at the lip 26. In other implementations, the rotationally symmetric cone-shaped portion may be referred to as being a part of the second optical stage or second end 8. As shown, the second optical stage 8 includes upper reflector 30, which may be cone-shaped in particular implementations and also opposes the opening 16. Also, in particular implementations, the opening 16 may have a second opening diameter 34 at an end 36 of the opening 16 located beyond the lip 26. As illustrated, the second opening diameter 34 may be smaller than the first bowl diameter 22 and the opening 16 may taper from the first bowl diameter 22 to the second opening diameter 34. In particular implementations, however, the opening 16 may be sized only to accommodate the dimensions of the LED 10 over which the optic 4 is coupled.

Figure 3:
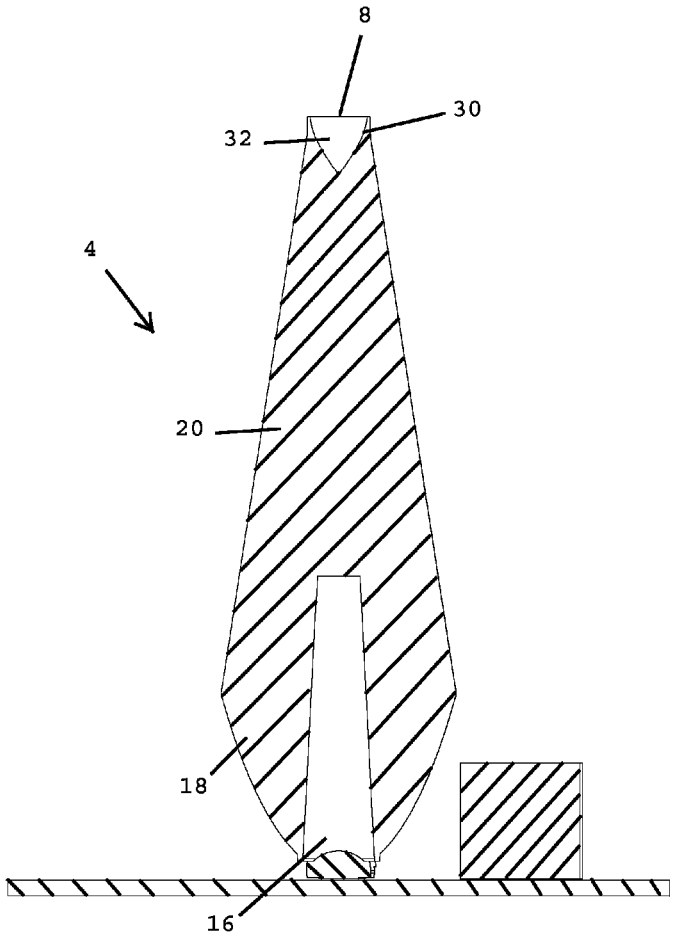
FIG. 3 is a cross sectional view of an LED optical system taken along sectional line A in FIG. 1.

Referring to FIG. 3, a cross-sectional view of the optic 4 illustrated in FIGS. 1 and 2 is shown taken along sectional line A. As illustrated, the cross-section hatching indicates that in particular implementations, the optic 4 is solid, and may be formed as one integral piece, or formed of one or more pieces coupled together. For example, the rotationally symmetric bowl-shaped portion 18 and the rotationally symmetric cone-shaped portion 20 may be formed separately and coupled together. In other implementations, the portions 18, 20 may be coupled by being integrally formed as a single piece. The opening 16 may be created either through the forming process used to make the optic 4 or may be added afterward through any type of drilling or other removal process. The upper reflector 30 may be coupled into a cone-shaped opening 32 in the second optical stage or second end 8 as a separate piece or may be formed by applying various materials to the surface of the cone-shaped opening 32 to form a stack of material with the desired reflective properties. The stack may be an optimized stack and/or may include a border with a cladding material having a desired index of refraction. Examples of materials that may be used to form the stack for the upper reflector 30 include aluminum, silver, gold, chromium, a dielectric material, a material with a higher index of refraction than the material included in the optic, a material with a lower index of refraction than the material included in the optic, and any combination thereof. In some implementations, no other coating materials may be applied to the surfaces of the first stage 6; in other implementations, various reflective or non-reflective coatings may be added to improve and/or enhance performance of the optic 4 as desired. As illustrated in FIGS. 1-3, the upper reflector 30 has a diameter smaller than a largest diameter of the first optical stage 6. In the implementation illustrated in FIGS. 1-3, the second bowl diameter 24 at the lip 26 is the largest diameter of the first optical stage or first end 6.

Figure 4:
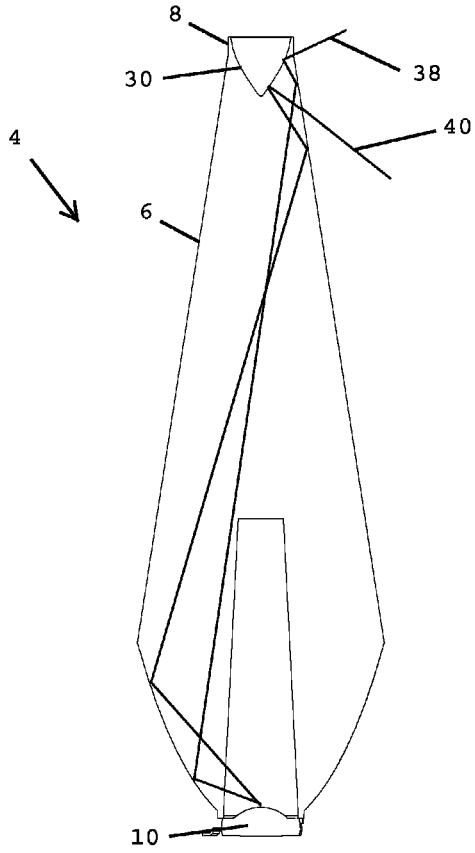
FIG. 4 is a cross sectional view of an optic for an LED optical system taken along sectional line A of FIG. 1 illustrating the movement of two hypothetical light rays within and out of the optic.

Referring to FIG. 4, another cross-sectional view of the optic 4 illustrated in FIGS. 1-3 is illustrated taken along sectional line A. The reflection paths for two light rays 38, 40 emitted from the LED through the optic 4 are shown. In particular implementations of LED optical systems 2, the first optical stage 6 of the optic 4 is a total internal reflector utilizing the principle of total internal reflectance to focus the light received from the LED on the upper reflector 30 in the second optical stage 8. Total internal reflectance occurs when the light emitted by the LED encounters the surface of the first optical stage 6 at an angle larger than a critical angle from a line normal to the surface and reflects from the surface internally within the optic 4. The conditions for total internal reflectance exist when the index of refraction of the material on the other side of the surface of the first optical stage 6 is either higher or lower than the material composing that portion of the optic 4. If light encounters the surface at an angle less than the critical angle, then some or all of the light will pass through the surface. Accordingly, if the shape of the first end or first optical stage 6 (and the rotationally symmetric cone-shaped portion 20 if included in the second optical stage 8) is properly shaped, substantially all of the light emitted in a dispersed pattern from the LED can be focused toward the upper reflector 30 by ensuring that each ray exiting the LED encounters the various surfaces of the first optical stage 6 at an angle greater than the critical angle. In particular implementations, implementations of openings 16 that extend into the optic 4 may be used to further refract the light emitted from the LED and aid in focusing it on the upper reflector 30.

Because of the use of a total internal reflector in the first optical stage 6, the actual distance of the upper reflector 30 from the LED 10 is adjustable by changing the angles and dimensions of the other portions of the optic 4. As a non-limiting example, the dimensions of a particular implementation of an optic 4 are listed as follows. The distance from the opening 16 to the end of the second stage 8 may be 69.5 mm. The first bowl diameter 22 may be 7.2 mm, the second bowl diameter 24 may be 24.1 mm, the diameter of the second end 8 may be 5.7 mm, and the diameter of the second opening diameter 34 may be 4.5 mm. The second opening diameter 34 may be located 27 mm from the first bowl diameter 22. The rotationally symmetric bowl-shaped portion 18 may have a prescription radius of 0.14600712, a conic value of −1.5529649, an $r^2$ coefficient value of 0.086173255, an $r^4$ coefficient value of 0.086173255, an $r^6$ coefficient value of 0.00073778525, an $r^8$ coefficient value of $-1.7248246*10^{-8}$, an $r^{10}$ coefficient value of $1.6222659*10^{-8}$, an $r^{12}$ coefficient value of $-1.0610686*10^{-8}$, an $r^{14}$ coefficient value of $4.2512354*10^{-7}$, and an $r^{16}$ coefficient value of $3.7660471*10^{-8}$. The rotationally symmetric cone-shaped portion 20 may have a prescription radius of 3.2931791, a conic value of −0.96319151, an $r^2$ coefficient value of −0.041444393, an $r^4$ coefficient value of $-1.1642642*10^{-5}$, an $r^6$ coefficient value of $-1.1015019*10^{-7}$, and an $r^8$ coefficient value of $-1*10^{-10}$.

Substantially all of the light received from the LED 10 by the optic 4 may be emitted as it reflects from the upper reflector 30 and encounters the surface of the optic 4 at an angle less than the critical angle. Since the emission will occur generally in the area of the optic 4 surrounding the upper reflector 30, the optic 4 may emulate a point light source, or, in other words, the light visible from implementations of LED optical systems 2 may resemble light emitted from a point location in a substantially spherical or toroidal pattern. The first stage 6 and second stage 8 of the optic 4, in combination with the upper reflector 30, also allow the transmission of the light from the LED 10 from the circuit board a predetermined distance above the circuit board, without requiring the use of mirrors or specialized assembly procedures for mounting the LED 10 above the surface of the circuit board, though of course such mirrors or specialized assembly procedures could be used in particular implementations. The dimensions of the optic 4 can be designed to handle the light emission patterns of any of a wide variety of LED types, such as Lambertian emission pattern LEDs, and LEDs emitting any other type of emission pattern.

Figure 5:
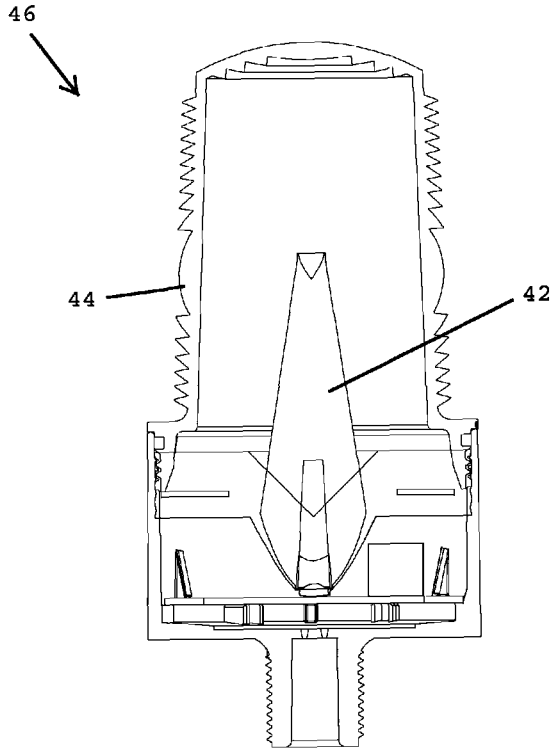
FIG. 5 is a cross sectional view of an LED optical system with an outer lens mounted over the optic.

Referring to FIG. 5, a cross sectional view of another implementation of an LED optical system 42 with an outer lens 44 coupled over it along with related components is illustrated. Because the LED optical system 42 may be configured to emulate a point light source, the system 42 may be used as a point light source for the outer lens 44. The outer lens 44 illustrated in FIG. 5 is configured to transmit the light received from the LED optical system 42 in a substantially lateral direction, thereby creating a laterally emitting LED optical device 46, operated using the light from, in particular implementations, one LED. However, many other implementations of outer lenses 44 could be used and many other optical components could be employed to direct the light in any other desired direction, pattern, or orientation. The outer lens 44 shown in FIG. 5 is a Fresnel lens; in other implementations, any other type of lens (including a rotational Fresnel lens) capable of handling or directing the light may be utilized. Those of ordinary skill in the art will readily be able to determine desirable outer lens designs to create desired LED emission patterns using the principles disclosed in this document.

Figure 6:
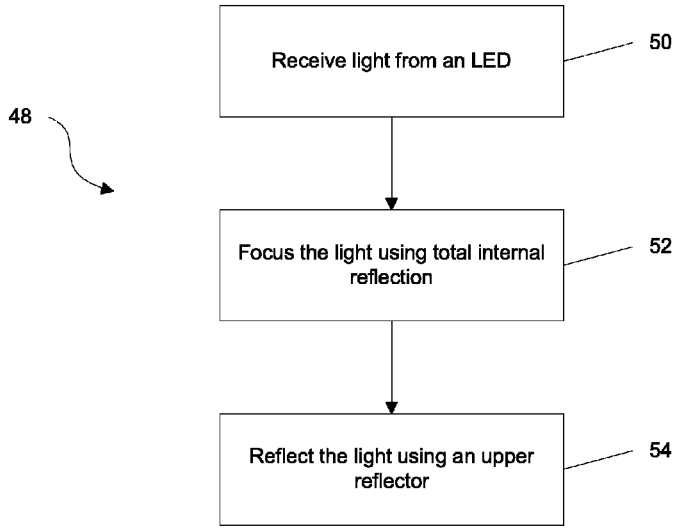
FIG. 6 is a flow chart of a implementation of a method of distributing light from a LED.

Implementations of LED optical systems 2, 42 disclosed in this document may utilize implementations of a method of distributing light from an LED 48. Referring to FIG. 6, the method 48 may include receiving light from an LED (step 50), focusing the light using total internal reflection on an upper reflector (step 52), and reflecting the light using the upper reflector (step 54). In particular implementations, the upper reflector may have a diameter smaller than the largest diameter of a first end or first optical stage of the optic. The method may also include emulating a point light source for an outer lens coupled over the LED and generating a substantially lateral light pattern with the outer lens.

In places where the description above refers to particular implementations of LED optical systems, it should be readily apparent that a number of modifications may be made without departing from the spirit thereof and that these implementations may be applied to other LED optical systems.

The invention claimed is:

1. A light emitting diode (LED) optical system comprising:
an LED coupled with a circuit board; and
an optic comprising:
a first end and a second end, the second end opposing the first end; and
a first optical stage including the first end and a second optical stage including the second end;
wherein the first optical stage comprises a total internal reflector and has a rotationally symmetric cone-shaped portion coupled to a rotationally symmetric bowl-shaped portion and the second optical stage comprises an upper reflector located at the second end;
wherein the rotationally symmetric bowl-shaped portion is coupled around the LED at the first end; and
wherein the second optical stage is configured to emulate a point light source for an outer lens coupled over the LED optical system using light emitted from the LED.

2. The system of claim 1, wherein the LED is a Lambertian radiation pattern LED.

3. The system of claim 1, wherein the optic comprises an opening configured to receive the LED, wherein the opening tapers into the optic beyond an end of the rotationally symmetric bowl-shaped portion of the optic and into the rotationally symmetric cone-shaped portion of the first optical stage.

4. The system of claim 1, wherein the upper reflector is substantially cone-shaped and comprises a stack comprising at least one of aluminum, silver, gold, and chromium.

5. The system of claim 1, wherein the upper reflector is substantially cone-shaped and comprises a stack comprising at least one of a material with a higher index of refraction than a material included in the optic and a material with a lower index of refraction than a material included in the optic.

6. The system of claim 1, wherein the second optical stage is configured to produce a substantially lateral light pattern when the outer lens is coupled over the LED optical system.

7. The system of claim 6, wherein the outer lens is a Fresnel lens.

8. An optical system for a light emitting diode (LED), the optical system comprising an optic comprising:

a first end comprising a rotationally symmetric bowl-shaped portion with an opening therein configured to couple over an LED, the opening having a first bowl diameter, the opening centered within the rotationally symmetric bowl-shaped portion, wherein the rotationally symmetric bowl-shaped portion enlarges from the first bowl diameter to a second bowl diameter at a lip of the rotationally symmetric bowl-shaped portion opposing the opening; and a second end opposing the first end, the second end comprising a rotationally symmetric cone-shaped portion physically coupled with the rotationally symmetric bowl-shaped portion at the lip, the rotationally symmetric cone-shaped portion having a first cone diameter substantially equal to the second bowl diameter and a second cone diameter smaller than the first cone diameter at a cone end opposing the rotationally symmetric bowl-shaped portion;

wherein the second end includes an upper reflector coupled at the cone end, the upper reflector having a diameter substantially equal to the second cone diameter.

9. The optical system of claim 8, wherein the opening in the rotationally symmetric bowl-shaped portion extends into the optic toward the second end of the optic beyond the lip.

10. The optical system of claim 9, wherein the opening comprises a second opening diameter at an end of the opening located beyond the lip, wherein the second opening diameter is smaller than the first bowl diameter and the opening tapers from the first bowl diameter to the second opening diameter.

11. The optical system of claim 8, wherein the upper reflector is substantially cone-shaped and comprises a stack comprising at least one of aluminum, silver, gold, and chromium.

12. The optical system of claim 8, wherein the upper reflector is substantially cone-shaped and comprises a stack comprising at least one of a material with a higher index of refraction than a material included in the optic and a material with a lower index of refraction than a material included in the optic.

13. The optical system of claim 8, further comprising a housing including an outer lens coupled over the optic and configured to emulate a point light source for the outer lens using light emitted from the LED.

14. The optical system of claim 13, wherein the optic system is configured to produce a substantially lateral light pattern when the outer lens is coupled over the LED optical system.

15. The optical system of claim 13, wherein the outer lens comprises a Fresnel lens.

16. An optical system for a light emitting diode (LED) comprising an optic comprising:

a rotationally symmetric cone-shaped portion of a first optical stage comprising a total internal reflector coupled to a rotationally symmetric bowl-shaped portion of the first optical stage; and a second optical stage comprising an upper reflector, the upper reflector opposing an opening in the first optical stage;

wherein the rotationally symmetric bowl-shaped portion is configured to couple around an LED at the opening in the first optical stage; and wherein the upper reflector has a diameter smaller than a largest diameter of the first optical stage.

17. The optical system of claim 16, further comprising an opening tapering into the first optical stage beyond an end of the rotationally symmetric bowl-shaped portion of the first optical stage into the rotationally symmetric cone-shaped portion of the first optical stage.

18. The optical system of claim 16, wherein the upper reflector is substantially cone-shaped and comprises a stack comprising at least one of aluminum, silver, gold, and chromium.

19. The optical system of claim 16, wherein the upper reflector is substantially cone-shaped and comprises a stack comprising at least one of a material with a higher index of refraction than a material included in the optic and a material with a lower index of refraction than a material included in the optic.

20. The optical system of claim 16, wherein the second optical stage is configured to produce a substantially lateral light pattern when a Fresnel lens is coupled over the LED optical system.

21. The optical system of claim 16, further comprising a housing including an outer lens coupled over the optic and configured to emulate a point light source for the outer lens using light emitted from the LED.

22. The optical system of claim 21, wherein the optic system is configured to produce a substantially lateral light pattern when the outer lens is coupled over the LED optical system.

23. The optical system of claim 22, wherein the outer lens comprises a Fresnel lens.

24. A method of distributing light from a light emitting diode (LED), the method comprising:

receiving light from an LED at a first end of an optic coupled over the LED;

focusing the light, using total internal reflection with a rotationally symmetric cone-shaped portion of the optic, onto an upper reflector included in a second end of the optic opposing the first end, wherein the upper reflector has a diameter smaller than a largest diameter of the first end and the rotationally symmetric cone-shaped portion is coupled to a rotationally symmetric bowl-shaped portion coupled around the LED; and reflecting the light from the second end of the optic using the upper reflector.

25. The method of claim 24, further comprising emulating a point light source for an outer lens coupled over the LED and the optic using the upper reflector.

26. The method of claim 25, further comprising generating a substantially lateral light pattern with the outer lens and the light from the LED.

* * * * *